United States Patent [19]

Erickson et al.

[11] 4,192,512

[45] Mar. 11, 1980

[54] BOARD GAME APPARATUS

[75] Inventors: Erick E. Erickson, Chicago; Jeffrey D. Breslow, Highland Park, both of Ill.

[73] Assignee: Marvin Glass & Associates, Chicago, Ill.

[21] Appl. No.: 874,013

[22] Filed: Jan. 31, 1978

[51] Int. Cl.[2] ..... A63F 3/00

[52] U.S. Cl. ..... 273/243; 273/288; 273/282; 46/116; 46/151

[58] Field of Search ..... 273/243, 288, 289; 46/115, 116, 151, 162

[56] References Cited

U.S. PATENT DOCUMENTS

| | | | |
|---|---|---|---|
| 1,635,978 | 7/1927 | Ross | 46/116 |
| 2,536,518 | 1/1951 | Shrier | 46/116 |
| 3,298,692 | 1/1967 | Glass | 273/243 |
| 3,684,291 | 9/1972 | Johmann | 46/116 |

*Primary Examiner*—Richard C. Pinkham
*Assistant Examiner*—R. Carl Moy
*Attorney, Agent, or Firm*—Mason, Kolehmainen, Rathburn & Wyss

[57] ABSTRACT

A board game designed arounda "monster" theme wherein the object of the game is to proceed from a starting area to a weapons pickup area while avoiding capture by the monster and after pick up of a weapon to be the first to hunt down and destroy the monster. The board game apparatus includes a game board having a playing surface and a travel path defined by a plurality of spaced apart play stations extending between a starting area and the pickup area for weapons. A plurality of playing pieces are adapted to be moved along the travel path between the play stations and a chance device is utilized for directing the movement of the playing pieces along the travel path. The game board playing surface also includes a plurality of spaced apart foot spaces arranged in pairs to straddle the travel path. A toy figure in the form of a monster having spaced apart feet is adapted to stand on pairs of the foot spaces and straddle the travel path when the monster is in a standing position. The monster includes a body having a pan for holding a quantity of cohesive gelatinous material or gel and the pan includes at least one opening which permits the gel material to drool downwardly into contact with the playing surface to provide a cohesive strand which forms an impediment to the movement or placement of the playing pieces along the path that is straddled by the monster. The cohesive strands of gel may pass over and knock down a playing piece. If a player is successful in moving his playing piece to the weapons pickup area, he is permitted to take a "mine" which may be operated as a lever to upset the monster and thereby win the game. The player who destroys the monster is declared the winner of the game.

19 Claims, 4 Drawing Figures

BOARD GAME APPARATUS

BACKGROUND OF THE INVENTION

1. Field of the Invention

The present invention relates to a board game apparatus and board games generally.

2. Description of the Prior Art

A wide variety of board games have enjoyed popularity with children and adults for many years. These games have been developed about a wide variety of themes and some of the themes have included various types of monsters or fictional characters, with an object being to avoid capture or destruction by the monster and the winner of the game being the player last remaining in play after all of the other players have been captured or destroyed by the monster.

SUMMARY OF THE INVENTION

The principal object of the present invention is to provide a new and entertaining board game and more particularly it is an object to provide a new and improved board game of the character described wherein a plurality of playing pieces are movable between play stations on a travel path on a playing surface between a starting area and a weapons pickup area with a monster-like toy figure also being movable over the playing surface between a plurality of different foot stations which straddle portions of the travel path at several locations.

Yet another object of the invention is to provide a new and improved board game of the character described in the foregoing paragraph wherein it is an object of the game to avoid the monster-like creature while moving along the travel path from the starting area to the weapons area and wherein the playing pieces reaching the pickup area are then afforded a weapon with which to hunt and eventually upset and destroy the monster.

Yet another object of the invention is to provide a new and improved board game wherein it is an object of the game to avoid the monster while traveling from a starting area to a remote area and thereafter the object changes to one of hunting down and destroying or upsetting the monster with a weapon.

It is an object of the present invention to provide a board game with a novel monster-like playing piece which utilizes a cohesive strand of viscous, mucous-like, gelatinous material or gel in combination with the playing surface of a game board for causing other playing pieces to be upset.

Yet another object of the present invention is to provide a new and improved game of the character described wherein novel means including gel is provided for upsetting the playing pieces used in the game.

These and other objects and advantages of the present invention are accomplished in one embodiment which includes a game board having a playing surface thereon with a travel path defined by a plurality of spaced apart play stations. A plurality of playing pieces including one for each player are adapted to be moved along the travel path between the play stations thereon from a starting area to a weapons pickup area. A chance device in the form of a spinner is provided for directing the movement of the playing pieces during each player's turn for a randomly determined number of play spaces along the travel path. When a playing piece reaches the weapons area, a weapon is provided.

A plurality of spaced apart foot spaces are provided over the playing surface and are arranged in pairs which straddle the travel path at several positions. A toy figure in the shape of a monster has a pair of spaced apart feet adapted to rest on selected pairs of foot spaces and is movable around the board as directed by the spinner. The monster includes a body supported on a pair of spaced apart upwardly extending legs and includes a pan for holding a quantity of viscous, mucous-like, highly cohesive gelatinous material or gel. The pan includes at least one opening which permits the gel material to flow downwardly out of the pan to contact the playing surface thereby forming one or more cohesive strands of drool which at least partially block the path of relative movement of the other playing pieces along the travel path between the legs of the monster. The spinner is used by each player in turn to direct the movement of the players and the monster around the different pairs of spaced apart foot spaces. During movement of the monster, the strands of gelatinous material or gel may engage the individual playing pieces are cause them to be knocked down whereupon the player must then return the playing piece back to the starting area. When a player successfully reaches the weapons pickup area, a weapon in the form of a "mine" is awarded and he then may use the weapon for upsetting and destroying the monster when he reaches a playing space close enough so that the weapon which is in the form of a lever may be manually operated to lift the foot of the monster to upset the same and thereby win the game.

BRIEF DESCRIPTION OF THE DRAWINGS

For a better understanding of the present invention, reference should be had to the following detailed description taken in conjunction with the drawings, in which.

DESCRIPTION OF THE PREFERRED EMBODIMENT

Figure 1:
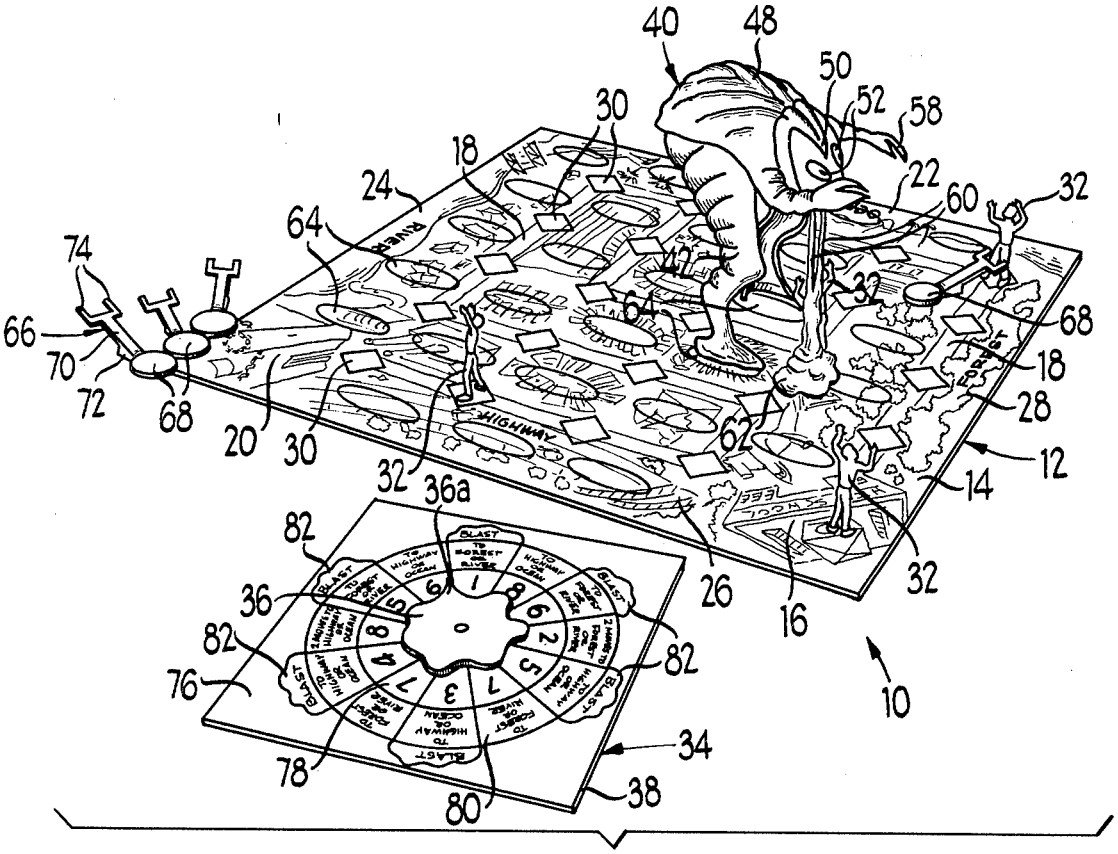
FIG. 1 is a perspective view of a game board apparatus constructed in accordance with the features of the present invention and shown in a condition as normally used in play.

Referring now more particularly to the drawings, therein is illustrated a new and improved board game developed around a theme wherein several playing pieces (each associated with a player) are moved around a playing board with the object of avoiding capture or upset by another larger playing piece fashioned in the form of a fictitious monster. After reaching a destination area termed an "armory," each player is given a weapon or mine and then seeks to be the first to reach and upset the monster with the mine and win the game.

In accordance with the invention, the game includes a relatively large, square or rectangular game board 12 having an animated playing surface 14 provided on one side thereof. On the playing surface, there is defined a starting area 16 designated as the "high school" and a tortuous travel path 18 leads from the starting area toward a destination area 20 at an adjacent corner represented as the armory. Along the travel path, the game board playing surface 14 is decorated to resemble a city scene with trees, buildings, houses, etc. with an ocean area 22 along one side. Along another side of the board, a river area 24 is designated and a highway area 26 is designated along another side. Along a fourth side is designated a forest area 28 running along an initial portion of the travel path 18 from the high school or starting area 16.

At intervals, the travel path is provided with a plurality of spaced apart, play stations 30 which are generally diamond-shaped and each play station provides a spot or space for one or more playing pieces 32 which resemble human figures, with one being provided for each of the players in the game. A total of four of the playing pieces 32 may be provided in the game and preferably they are formed of molded plastic material, with each one having a different color so that each player of the game is readily identified.

In order to direct the movement of the playing pieces 32 around the travel path 18, the game includes a chance device in the form of a spinner apparatus 34 having a manually operated, rotatable spinner 36 mounted at the center of a board or base 38 as shown in FIG. 1. The spinner is provided with a sharpened point 36*a* and a plurality of radial fingers which are used for manually spinning the device to point in a randomly determined direction after each spin. The game also includes another larger playing piece 40 formed as a fictional monster or prehistoric creature.

Figure 2:
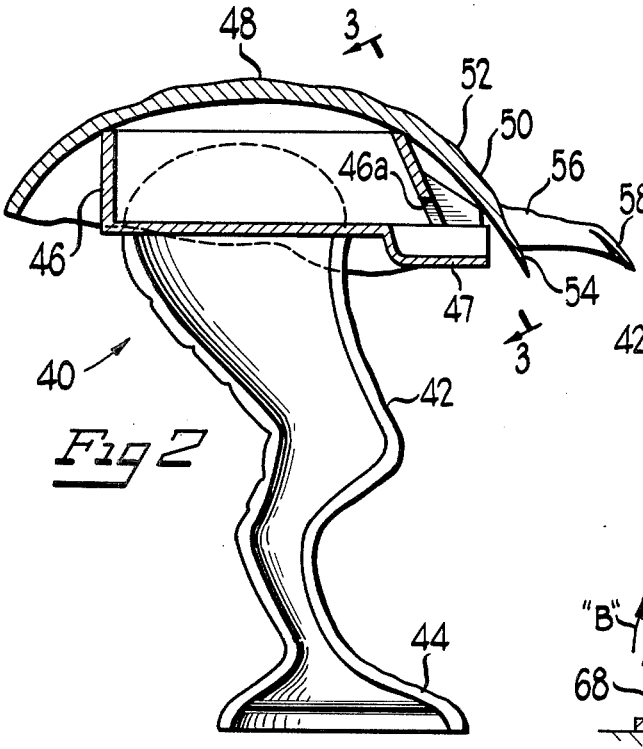
FIG. 2 is a vertical, cross-sectional view of one form of a monster-like playing piece in accordance with the present invention.
Figure 3:
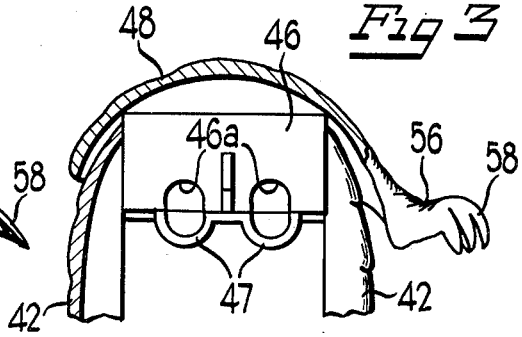
FIG. 3 is a fragmentary transverse cross-sectional view taken substantially along lines 3—3 of FIG. 2.

Referring to FIGS. 2 and 3, the monster includes a pair of relatively tall, upstanding legs 42 widely spaced apart in order to permit passage of a playing piece 32. Each leg has a relatively large oval shaped foot at the lower end such as to provide a relatively stable base for supporting the upstanding figure on a game board. At the upper ends, the legs 42 are joined to the opposite side walls of a generally rectangular pan or box 46 which is adapted to contain a volume of highly viscous, cohesive, gelatinous or mucous-like material or gel. The pan is open at the upper end to facilitate the placement of the gelatinous material in the pan and a loosely fitting top or back shell 48 is placed over the pan to cover the open upper end.

As illustrated, the removable back or shell 48 is irregularly shaped and at the forward end is decorated to resemble a head portion 50 of a pre-historic monster with a pair of spaced apart eyes 52 and a long downwardly and forwardly extending beak-like snout or nose 54 (FIG. 2). In addition, the back or shell also includes a pair of spaced apart, forwardly extending arms 56 with claw-like hands 58 at the outer ends. The pan for containing the viscous cohesive gelatinous material or gel includes a front wall sloping upwardly and rearwardly as shown in FIG. 2 and the front wall is formed with a pair of spaced apart, openings 46*a* along the lower edge thereof and a pair of outwardly extending troughs 47 so that the gel will pass outwardly and downwardly in one or more cohesive strands 60 of gel as shown in FIG. 1. Because of the cohesiveness nature and high viscosity of the gel, the individual strands of gel 60 do not break away from the body of material in the pan and additionally, a quantity of the viscous material forms in an irregular mass 62 at the lower end of the strands on the playing surface 14 of the game board 12. Because of the cohesiveness, the strands 60 and mass 62 of gel move along with the monster 40. When this material contacts or touches one of the human figures, playing pieces 32, the gel will often upset or knock over the playing piece which then, in accordance with the rules of the game, must be returned to the starting area 16 to begin afresh.

The monster 40 is movable around the playing surface 14 between pairs of spaced apart, elliptically shaped, foot spaces 64 which are disposed in parallel pairs to straddle or cross the travel path 18 at a plurality of different locations thereon. The foot spaces are dimensioned to accommodate the size of the large foot 44 of the monster and the spacing in one direction between pairs of the foot spaces is substantially equal to the spacing between the opposite feet of the monster 40. As illustrated in FIG. 1, all of the foot spaces are oriented with the long axes of the ellipse facing in a common direction. However, the monster is movable in all cardinal direction, forwardly, backwardly and sideways in either direction between the adjacent pairs of foot spaces 64.

Figure 4:
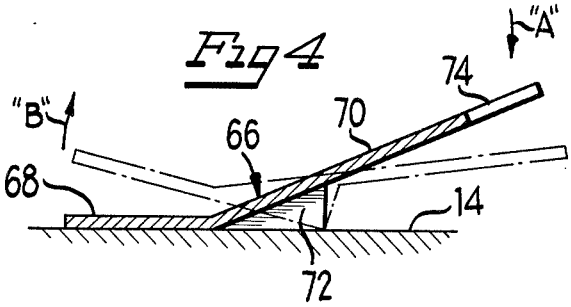
FIG. 4 is a side elevational view of one form of a weapon in accordance with the present invention to upset the monster.

When each player is successful in negotiating the tortuous travel path 18 from the starting area at the high school 16 all the way to the destination area or armory 20, the player is then provided with a weapon or mine 66 in the form of a lever as shown in FIG. 4. The player then proceeds to seek and upset or destroy the monster 40 to win the game. At least one mine 66 is provided for each of the playing pieces 32 and as shown in FIG. 4, each mine includes a circular, flat lower end portion 68 which is adapted to fit beneath one of the enlarged feet 44 of the monster.

Each mine includes an elongated body portion 70 sloping upwardly from the circular lower end 68 with a heel-type fulcrum 72 utilized for pivotal contact against the game board playing surface 14 when the mine is actuated by pivotal movement. At the upper end of the body, there is provided a pair of spaced apart fingers 74 forming a slot for accommodating the body portion of one of the human figure playing pieces 32. When a mine 66 is fired, the fingers 74 at the upper end are manually depressed downwardly as shown by the arrow "A" in FIG. 4, and this causes the lower, circular end or mine to tip upwardly as shown by the arrow "B." If the circular mine is positioned below one foot 44 of the monster 40, the monster will be upset or toppled over causing the back 48 to be knocked off of the monster so that the remaining gel in the cavity 46 is spilled on the board simulating complete destruction of the monster 40, and the player effecting this action is then the winner of the game.

In order to direct the movements of the individual playing pieces 32 and the monster 40 around the playing surface 14 on a "random" or "chance" basis, the spinner 34 is operated by the players on successive turns by manually spinning the pointer element 36. The upper surface 76 of the spinner board 38 is decorated or provided with indicia in a first or inner circular ring 78 divided into a plurality of radial segments each having a "number" therein for indicating the number of playing spaces 30 that each playing piece 32 is moved along the travel path 18 on a turn. Outwardly of the inner circle of numbers, the spinner board surface includes an outer circular ring 80 also having a plurality of segments radially aligned with each of the segments of the inner circle. The outer circle of radial segments include printed indicia for directing the movement of the monster 40 forwardly or rearwardly and laterally in either direction. The monster is movable laterally between the ocean area 22 and the highway area 26 on the one hand and longitudinally between the river area 24 and the forest area 28 on the other hand. Certain of the radial segments in the outer circle direct the movement of the monster for two consecutive spaces 64 on a selected axis of direction.

Around the outer circle 80, the spinner board surface 76 is provided with a plurality of circumferentially, radially, spaced apart, indicia areas 82 which are aligned with only a few of the radially aligned spaces of the inner and outer circles and accordingly a lesser number of the outer indicia spaces 82 are provided as shown. These indicia spaces direct the "blast" of the mines 66 for upsetting the monster when the mine circle is in position beneath a foot 44 of the monster 40 and is in contact with the playing piece 32 of a player.

In accordance with the game, each player chooses one of the human figure playing pieces 32 in a color that he likes. It is an object of the game to successfully negotiate the playing piece around the travel path 18 from the high school 16 or starting area to the armory 20 at the adjacent corner of the board, all the time avoiding the monster 40 and the drooling strands of gel 60 and the mass of gel 62. Once a player is successful in reaching the destination or armory 20, the player picks up one of the mines 66 and proceeds to track the monster and upset the monster by firing his mine.

In preparation for the game, the monster's top shell or back 48 is removed and the pan 46 is filled with the gelatinous viscous material. The material flows out through the front openings **46*a* in the pan and forms a pair of cohesive strands of drool 60 and a mass of gel material 62 on the surface 14 of the game board. The monster is initially positioned on a pair of the foot spaces 64 which are marked "start" and is set to face towards the forest area 28 as shown. All of the playing pieces 32 start from the high school area 16 and the player chosen first then manually spins the spinner 36 of the spinning device 34. As the pointer 36*a* of the spinner comes to rest on a radial segment of the inner circle 78, play is begun. As shown, for example in FIG. 1, when the pointer 36*a* comes to rest on a particular segment in the inner circle 78, that segment plus the adjacent segment in the outer circle directs the movement of the player's individual playing piece 32 and the monster 40. The player first moves the monster one or more foot spaces laterally in either direction toward or away from the highway area 26 or ocean area 22. The player then moves his own playing piece 32 along the diamond-shaped playing spaces 30 of the travel path 18 leading towards the armory area 20** by the number of spaces indicated on the segment in the inner circle.

If the monster is blocking the travel path 18 in front of a playing piece 32, the piece may not be moved past the space on which the gel strands 60 and 62 are present even though the number that is obtained on the spinner board 34 would permit movement beyond the monster. For each player's spin of the spinner 34, both the monster 40 and the player's individual playing piece 32 are moved. The monster is moved first and each player tries to move the monster in a direction hoping that strands 60 or mass of gel 62 will pass over one of the opponent's playing pieces 32 and cause the playing piece to be pulled down or knocked over. In moving the monster, the players must slide the monster quickly to the next pair of spaces and not beyond. If the playing piece 32 of an opponent is still standing after this is done, the player may continue without penalty. However, if a playing piece 32 is knocked over by the gel, then the player must return to the high school starting area 16 and start afresh. If a player's own playing piece is contacted by the gel strands from the monster, he may then move his playing piece out of the gel and block the path of the next player behind him.

After a player reaches the armory area 20, he waits until his next turn and then takes a mine 66 of an appropriate color matching his own playing piece and attempts to reach and then upset the monster. The player possessing a mine may be moved in either direction along the travel path 18 but can only move in one direction during a turn. The lower end or circle portion 68 is placed on any foot space 64 around the individual diamond-shaped playing space 30 occupied by the player. If the monster is forced to move onto the mine, the player owning the mine then gets to spin the spinning device 34. If the spinner pointer **36*a* points to one of the outer segments 82, the player may then press down on the finger portion 74 of his mine to upset and destroy the monster and thereby win the game. During a player's turn, if his playing piece 32 is moved close enough to the position of the monster, the player can then slip his mine 66 into position and spin the spinning device hoping for a chance to blast his mine. The first player to successfully upset and thereby destroy the monster 40** wins the game.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A board game comprising:

a gameboard having a playing surface thereon with a travel path defined by a plurality of spaced apart play stations;

a plurality of playing pieces including one for each player adapted to move along said travel path between said play stations;

chance means for directing the movement of each playing piece for an associated player's turn for a chance determined number of play spaces along said path;

a plurality of spaced apart foot spaces on said playing surface arranged in pairs straddling said travel path at several positions thereon; and a toy figure having a pair of spaced apart feet adapted to rest on pairs of said foot spaces and including a body supported on a pair of spaced legs extending upwardly of said feet, said body including a pan for holding a quantity of viscous mucous of cohesive, gelatinous material, said pan including at least one opening therein permitting said material to flow downwardly of said pan to contact said playing surface forming a cohesive strand at least partially blocking a path between said spaced legs above said playing surface below said pan.

2. The board game of claim 1 wherein said toy figure includes a removable cover above said pan permitting said gelatinous material to be replaced in said pan from above.

3. The board game of claim 2 wherein said toy figure is fashioned to resemble a monster-like creature with a decorative head on a frontal portion of said cover, said frontal portion extending forwardly beyond a front edge of said pan and said opening formed adjacent said front edge whereby said cohesive strand of gelatinous material appears to drool from the mouth of said creature.

4. The board game of claim 1 wherein said pan of said toy figure includes a bottom and an upstanding sidewall around the periphery thereof, said opening being formed in said sidewall.

5. The board game of claim 4 wherein said opening is formed adjacent the level of said bottom wall of said pan.

6. The board game of claim 4 wherein a portion of said sidewall slopes upwardly and inwardly of an edge of said bottom wall, said opening being formed in said portion with a lower edge adjacent said bottom wall.

7. The board game of claim 1 wherein said pan includes a pair of spaced apart openings providing a pair of cohesive strands of gelatinous material extending downwardly of said pan.

8. The board game of claim 7 wherein said openings are positioned intermediate said legs of said toy figure whereby said pair of cohesive strands of gelatinous material form an obstruction of substantial width between said legs.

9. The board game of claim 1 wherein said chance means includes indicia for directing the movement of said toy figure between different pairs of said foot spaces on said playing surface.

10. The board game of claim 9 wherein said chance means includes indicia for directing the movement of said playing pieces and/or said toy figure in chance determined directions on said playing surface.

11. The board game of claim 10 wherein said chance means includes indicia for directing the movement of said toy figure a chance determined distance on said playing surface.

12. The board game of claim 1 including at least one lever means having one end adapted to fit under and lift one foot of said toy figure, an intermediate fulcrum for supporting said lever for pivotal movement on said playing surface and a handle portion sloping upwardly at an opposite end adapted to be depressed to upset said toy figure from a standing position.

13. The board game of claim 12 wherein each of said playing spaces along said path is spaced apart from one or more associated foot spaces by a distance related to the length of said lever means whereby a playing piece landing on a particular playing space is eligible to position said one end of said lever means on one of said associated foot spaces.

14. The board game of claim 13 wherein said chance means includes indicia for directing operation of said lever means to upset said toy figure when one foot thereof is resting on said one associated foot space with said one end of said lever means thereon.

15. A toy figure comprising:

a body having a pan with an open upper end for containing a quantity of cohesive gelatinous material, a pair of legs for supporting said body at an elevated position above a playing surface, and at least one opening in said pan permitting said cohesive gelatinous material to flow downwardly to said playing surface forming a cohesive strand of material between said legs;

said pan including a pair of said openings laterally spaced along a front wall thereof and said back including a portion extending forwardly of said front wall outwardly above said openings, said portion shaped and decorated as the head of a monster-like creature.

16. The toy figure of claim 15 wherein said body includes a removable back for covering the open end of said pan and extending outwardly around the edges thereof.

17. The toy figure of claim 15 including a pair of troughs extending outwardly of said openings for carrying said gelatinous material outwardly of said front wall to form said cohesive strands forwardly thereof.

18. The toy figure of claim 15 wherein said back includes a pair of forwardly extending arms along opposite sides projecting forwardly beyond the head of said monster-like creature.

19. The toy figure of claim 16 wherein said legs are formed to include relatively large feet open on both sides to permit the insertion of a member under said feet for the purpose of upsetting the toy figure.

* * * * *